United States Patent [19]

Hayward et al.

[11] Patent Number: 4,676,712

[45] Date of Patent: Jun. 30, 1987

[54] POSITIONING AND LOCKING APPARATUS

[76] Inventors: Milton L. Hayward, 2305 Greenbrook Blvd.; William H. Harper, 1454 Amon Dr., both of Richland, Wash. 99352

[21] Appl. No.: 746,476

[22] Filed: Jun. 19, 1985

[51] Int. Cl.[4] ..... B67B 7/00

[52] U.S. Cl. ..... 414/411; 29/240; 376/272; 414/146

[58] Field of Search ..... 414/403, 404, 411, 146, 414/217; 29/240; 81/3.2, 3.31, 3.33; 221/188; 376/272, 260, 340, 341; 53/317, 331.5

[56] References Cited

U.S. PATENT DOCUMENTS

| | | | |
|---|---|---|---|
| 2,034,878 | 3/1936 | Podel | 81/3.2 X |
| 3,262,247 | 7/1966 | Scholle | 53/317 |
| 4,171,650 | 10/1979 | Cardinal | 81/3.2 |
| 4,569,281 | 2/1986 | Woods | 81/3.33 X |
| 4,605,469 | 8/1986 | Shih et al. | 414/217 X |

*Primary Examiner*—Frank E. Werner
*Assistant Examiner*—David A. Bucci
*Attorney, Agent, or Firm*—Edward V. Hiskes; Robert Southworth, III; Judson R. Hightower

[57] ABSTRACT

A positioning and locking apparatus including a fixture having a rotatable torque ring provided with a plurality of cam segments for automatically guiding a container into a desired location within the fixture. Rotation of the ring turns the container into a final position in pressure sealing relation against a hatch member.

4 Claims, 6 Drawing Figures

POSITIONING AND LOCKING APPARATUS

The U.S. Government has rights in this invention pursuant to Contract No. DE-AC06-76FF02170 between the U.S. Department of Energy and the Westinghouse Electric Corporation.

BACKGROUND OF THE INVENTION

This invention relates generally to a positioning and locking apparatus for facilitating the opening of canisters containing toxic and/or radioactive powder materials.

In the handling of toxic materials, such as radioactive materials for example, strict accountability is required to preclude loss and/or misplacement of such materials and to prevent inadvertent human contact therewith. It is especially difficult to maintain proper accountability and prevent the spread of contaminants when handling bulk powder materials. In a typical fuel fabricating facility for example, special nuclear powdered material, such as uranium or plutonium oxides, must be removed from specially designed canister assemblies for processing and ultimate fabrication into desired fuel pellets. These specially designed canister assemblies comprise an inner canister contained and snuggly nested within an outer canister to provide a double containment barrier for the radioactive material. The inner canister contains radioactive material provided with its own sealed removable lid. The outer canister also is provided with a sealed removable cap or lid. Manually handling these canister assemblies and removing the outer canister lid to gain access to the inner canister is not only difficult and time consuming requiring a high degree of dexterity and strength, but also poses a safety hazard.

Accordingly, it is a primary object of the present invention to provide a solution to the above problem by providing an apparatus for remotely and automatically positioning and locking such canister assemblies in place to facilitate removal of the inner canister or container from the outer canister.

It is another object of this invention to provide a positioning fixture for accommodating and properly orienting a canister assembly to assist in the removal of the outer canister lid.

It is a further object of the present invention to provide the foregoing fixture with a guide arrangement assuring proper orientation of the canister assembly within said fixture.

These and other objects, advantages, and characterizing features of the present invention will become clearly apparent from the ensuing detailed description of an illustrative embodiment thereof, taken together with the accompanying drawings wherein like reference characters denote like parts throughout the various views.

SUMMARY OF THE INVENTION

A positioning and locking apparatus comprising a support and a fixture mounted thereon. The fixture includes a rotatable ring provided with a plurality of segments formed with cam surfaces for automatically guiding a container into a desired elevation within the fixture. The ring is rotated to turn the container and insert lugs formed thereon into slots formed in the support for slightly raising the canister into a vacuum locked relation against a seal provided on a hatch member.

DETAILED DESCRIPTION OF THE PREFERRED EMBODIMENT

Figure 1:
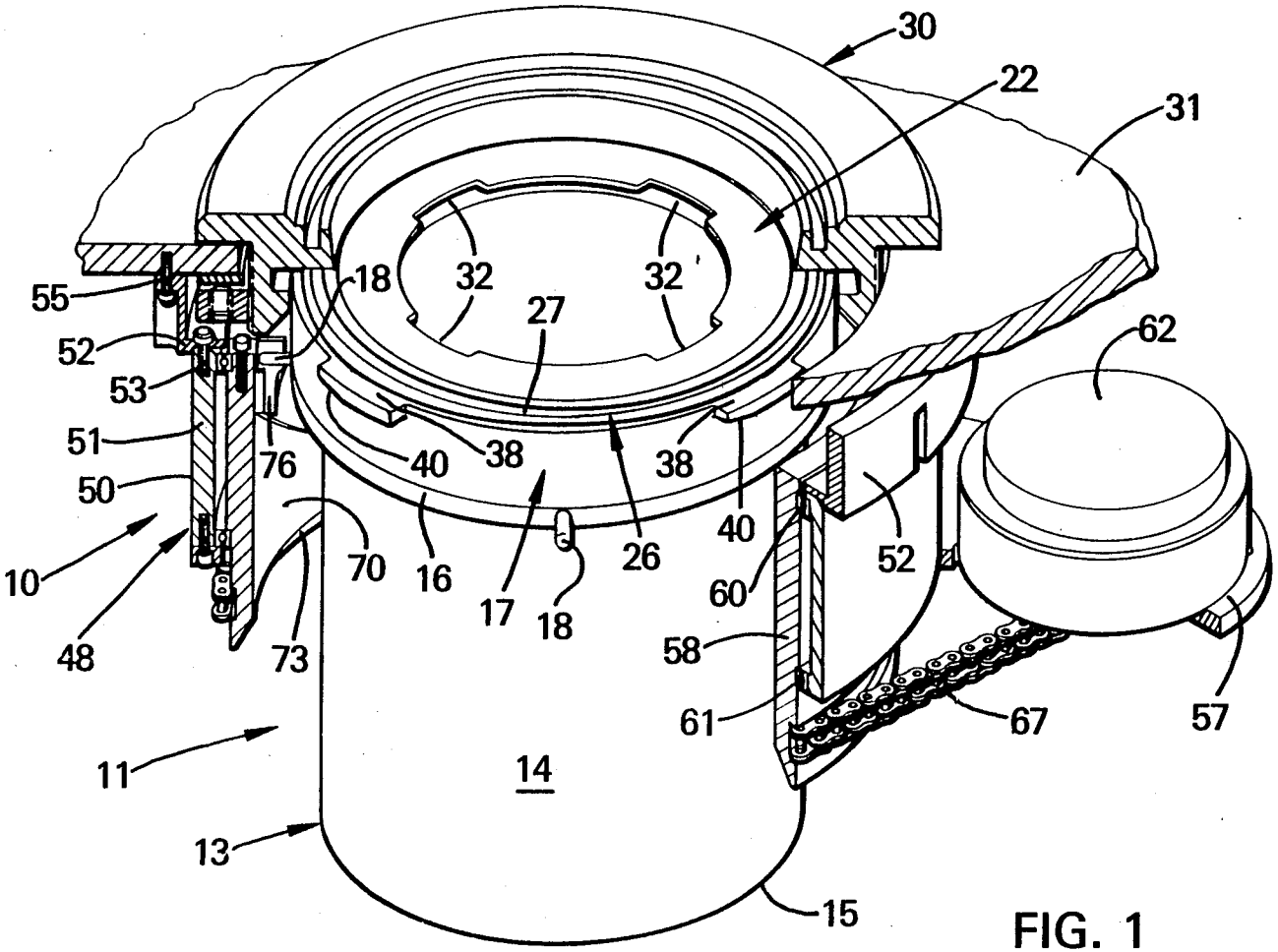
FIG. 1 is a perspective view, partly in section, of the positioning and locking apparatus of this invention, showing a canister assembly received therein.

Referring now in detail to the illustrative embodiment depicted in the accompanying drawings, there is shown in FIG. 1 a positioning and locking apparatus, comprehensively designated 10, constructed in accordance with this invention for orienting and securing a canister assembly 11 in place to facilitate removal of the sealed lid thereon. The canister assembly 11 comprises an inner canister (partially shown at 12 in FIG. 5) for containing powdered material and which is completely enclosed in an outer canister 13. The outer canister 13 includes a cylindrical body 14 having a closed end 15 and an integral, outturned flange 16 at its open end for supporting an end cap or lid, generally designated 17. A series of pins 18 at circumferentially spaced distances about the periphery of flange 16 project radially outwardly therefrom for guiding the canister assembly 11 into the apparatus 10 as will hereinafter be more fully described.

The lid 17 includes an outer rim 20 rigidly secured to flange 16, as by suitable fasteners 21 (FIG. 5), and an inner rotatable closure member 22 removably attached to the outer rim 20 by a tongue 23 and groove 24 arrangement. An annular 0-ring seal 25 is provided between the flange 16 and rim 20 to provide a fluid tight seal therebetween. An annular seal 26 of a specially configurated shape in cross section is interposed between the opposed lateral surfaces of rim 20 and closure member 22 to form an airtight seal therebetween. This seal 26 also has an upper corrugated surface 27 in sealing engagement against the underside of an inwardly extending portion 28 of an annular flange assembly 30 supported on a mounting plate 31. The upper end of the closure member 22 is formed with recessed portions 32 (FIG. 1) on the inner periphery thereof for the reception of complementary shaped lugs 33 forming a part of a cell port or hatch member 35 (only partially shown in FIG. 5) operable, in conjunction with an actuator (not shown), to rotate the closure member 22 sufficiently relative to rim 20 to free the tongue 23 from groove 24 and permit removal of the closure member 22. The hatch 35 also includes a seal 36 affixed thereto and projecting radially beyond the lugs 33 to engage against the top planar surface 37 of closure member 22. This seal 36 along the juncture of its bottom and outer side surfaces forms a line contact with the corner of seal 26 to provide a fluid tight line seal.

The upper end of the outer rim 20 is provided with a plurality of circumferentially spaced, lateral projections or lugs 38 extending radially from the periphery of rim 20 and having inclined cam surfaces 40 along the bottom thereof for a purpose that will hereinafter become apparent.

Means are provided for attaching the flange assembly 30 to mounting plate 31, such means including a nut 41 (FIG. 2) enmeshed with the threaded portion 42 of the skirt portion of the flange assembly 30. The nut 41, in turn, is provided with a plurality of circumferentially spaced tapped bores 43 for receiving set screws 45 bearing against a retaining ring 46 for clamping the plate 31 between a radial extension 47 of the flange assembly 30 and the retaining ring 46.

The apparatus 10 includes a fixture, generally designated 48, comprising a housing 50 provided beneath the mounting plate 31 and having a cylindrical body 51 coaxially aligned with the flange assembly 30. The housing body 51 is attached to the mounting plate 31 by means of an annular mounting ring 52 rigidly secured to the body 51 by suitable fasteners 53 and to the underside of mounting plate 31 by fasteners 55. The lower end of body 51 is secured to a mounting plate 56 having an extension 57 for supporting a motor operable for a purpose hereinafter explained.

A torque ring 58, in the form of a rotatable cylinder, is mounted concentrically within housing 50 for rotation relative thereto by means of a pair of vertically spaced annular bearings 60 and 61. The means for rotating the torque ring 58 includes a reversible electric motor 62 secured to the mounting plate extension 57 by means of suitable fasteners 63. The motor 62 is connected to a suitable source of electric power (not shown) and is provided with an output shaft 65 (FIG. 2) having a sprocket 66 mounted thereon. This sprocket 66 meshes with a roller chain 67 suitably affixed to the torque ring 58 on the side opposite motor 62. Energization of the motor 62 rotates shaft 65 and sprocket 66 to drive the chain 67 and rotate torque ring 58 in the appropriate direction for a purpose that will presently become apparent. The motor 62 is connected to a suitable programmed controller (not shown) effective to energize and deenergize motor 62 and control the direction of rotation thereof.

Figure 2:
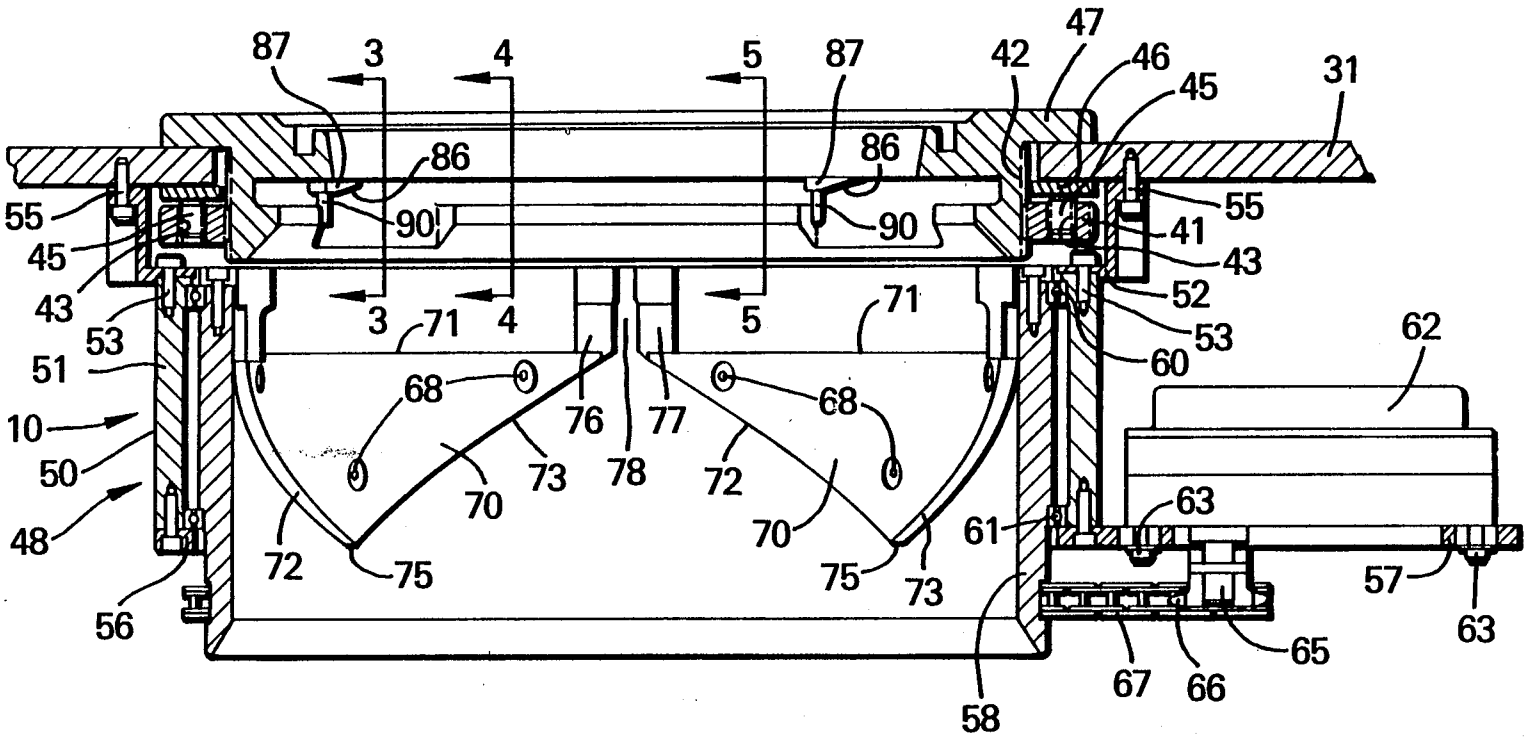
FIG. 2 is a vertical sectional view of the positioning and locking apparatus constructed in accordance with this invention.
Figure 6:
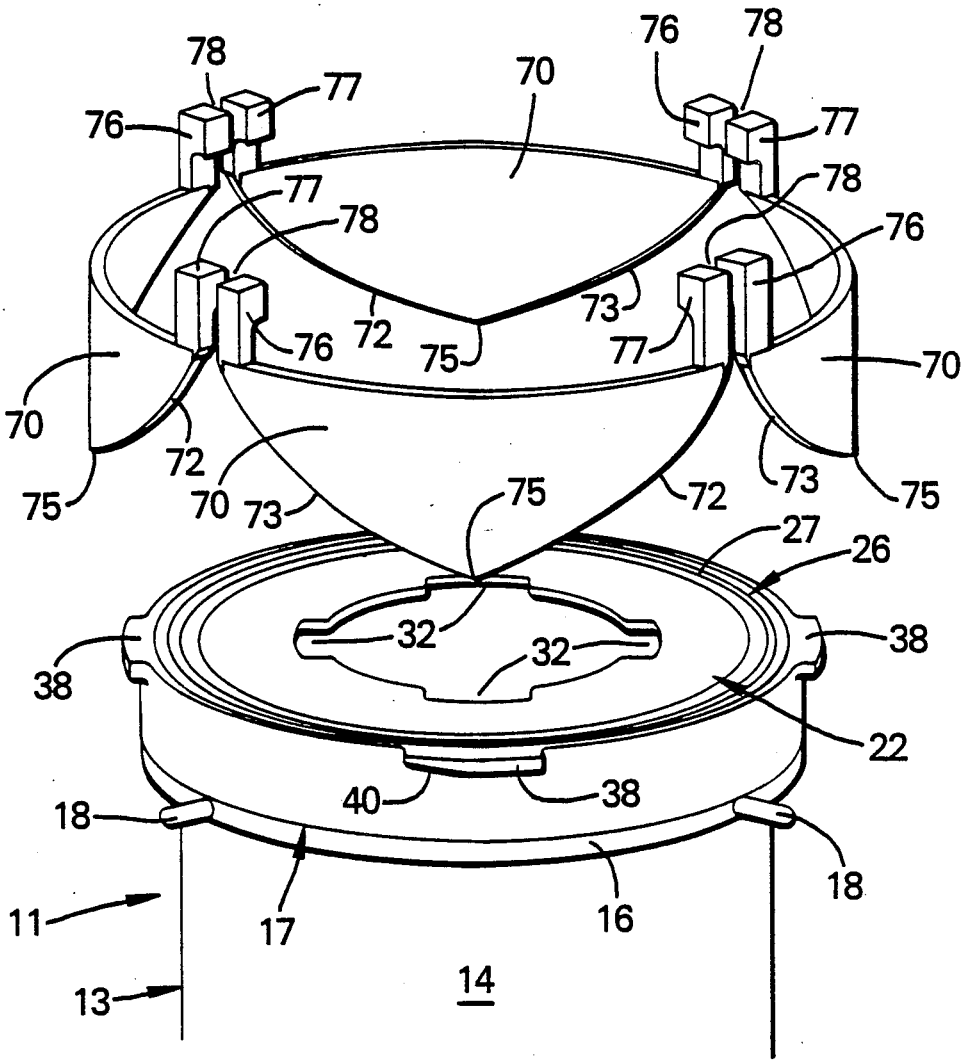
FIG. 6 is a perspective view showing a canister assembly relative to the cam segments forming a part of the positioning and locking apparatus of this invention.

As best shown in FIGS. 2 and 6, a plurality of arcuate cam segments 70, preferably four in number, are attached, as by fasteners 68, to the inner surface of torque ring 58. Each of these segments 70 is of a generally V-shaped configuration with an upper flat edge 71 and two slightly curved edges defining cam surfaces 72 and 73 extending from upper edge 71 downwardly in a converging relation and joined together at an apex 75. Each segment 70 also is provided with a pair of torquing lugs 76 and 77 disposed at the opposite ends thereof along upper edge 71. Upon insertion of the canister assembly 11 upwardly, as by means of a suitable elevator or lift device (not shown), into the housing 50, the cam surfaces 72 and 73 guide the pins 18 of the canister assembly 11 upwardly toward the slots 78 defined between opposed lugs 76 and 77. Accordingly, regardless of the orientation of canister assembly 11 when initially lifted into the housing 50, engagement of the pins 18 at any point along either of the cam surfaces 72 or 73 will turn and guide the canister assembly 11 along such surfaces for insertion into slots 78 to properly orient such canister assembly 11.

Figure 3:
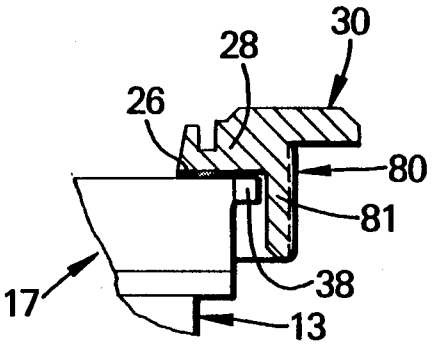
FIG. 3 is a vertical fragmentary sectional view, taken along line 3—3 of FIG. 2.
Figure 4:
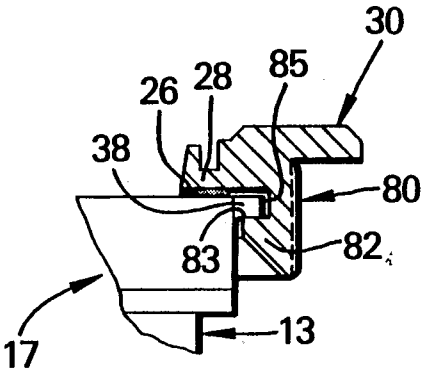
FIG. 4 is a vertical sectional view, taken along line 4—4 of FIG. 2.

The flange assembly 30 is formed with a skirt 80 having circumferentially spaced straight depending portions 81 (FIG. 3) to provide vertical clearance for the lugs 38 and circumferentially spaced, stepped portions 82 (FIG. 4) to define shoulders 83 and slots 85 for accommodating the lugs 38 upon rotation of the canister assembly 11 as will be presently described.

Once the canister assembly 11 is raised into its upper position within torque ring 58, the motor 62 is energized to rotate, via sprocket 66 and roller chain 67, the torque ring 58 in a clockwise direction as viewed in FIG. 1 to an extent programmed into the controller. Rotation of the torque ring 58 carries therewith the cam segments 70 and lugs 76 and 77, the latter engaging the pins 18 to effect rotation of the canister assembly 11. As the lugs 38 rotate along with the canister assembly 11, the cam surfaces 40 thereof encounter the leading edge of the shoulders 83 to facilitate entry of the lugs 38 into slots 85 and slightly raise the canister assembly 11 until the latter reaches its uppermost home position, pressing the top surface 37 of the outer canister closure member 22 against the seal 36 of hatch 35, which is in its lower, operative position. In this final secured position shown in FIG. 5, the lugs 38 are properly located within slots 85 and the upper surface 37 of the closure member 22 is firmly engaged with a slight cohesive force against the seal 36 of hatch 35.

Once the canister assembly 11 is properly located and locked in place, the hatch 35 is rotated by exterior means not forming a part of this invention to disengage the tongue 23 from groove 24 to detach the closure member 22 from outer rim 20. The hatch 35 can then be lifted as by a suitable remotely operable robotic manipulator (not shown) to withdraw the closure member 22 therewith from outer canister 13. Thus, access is provided into the outer canister 13 for removing the inner canister 12 therefrom. The inner canister is opened at another station by means not forming a part of this invention and emptied of its contents. The inner canister 12 can then be returned into outer canister 13.

Figure 5:
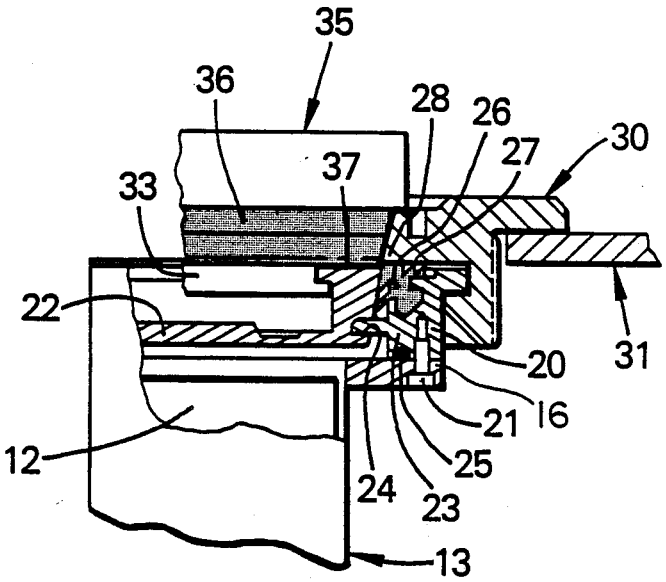
FIG. 5 is a vertical sectional view, taken along line 5—5 of FIG. 2.

With the empty canister in place within outer canister 13, the hatch 35 is lowered to replace the closure member 22 and rotated by an exterior actuator (not shown) to bring tongue 23 into interlocking engagement within groove 24 (FIG. 5). The motor 62 is then energized to rotate sprocket 66 and drive roller chain 67 in the opposite direction to return the torque ring 58 to its initial position. As the torque ring 58 and thereby canister assembly 11 is rotated in a reverse direction, the lugs 38 engage the inclined surfaces 86 of a plurality of circumferentially spaced wedge blocks 87, causing the canister assembly 11 to be displaced downwardly away from hatch 35 and breaking the vacuum seal between closure member 22 and seal 36. An abutment pin 90 extends downwardly through each wedge block 87 and serves as a stop engagable by an associated lug 38 for limiting the return rotary motion of canister assembly 11. The canister assembly 11 is free to be lowered out of housing 50.

Activation of motor 62 and other components herein mentioned are effected by the programmed controller for the proper sequential operation described. Of course, in lieu of a computer programmed control, activation of these devices to obtain the forgoing sequence of operations can be effected by conventional limit switches and/or electrical timing arrangements operable when predetermined movements of parts occur so that the termination of one operation sequentially triggers the initiation of the next succeeding operation.

From the foregoing, it is apparent that the objects of the present invention have been fully accomplished. As a result of this invention, an apparatus is provided for remotely and automatically precisely locating and locking a container in place within a contaminated environment while avoiding human contact therewith. By the provision of cam segments 70, the canister assembly, regardless of initial orientation, is properly guided into its upper position within the fixture 48. The lugs 38 along with the slots 85 formed in the flange assembly 30, assist in finally locking the canister in place to permit removal of the closure member therefrom. The wedge blocks 87, in conjunction with lugs 38, effect separation of the canister from the hatch seal upon reverse rotation of the canister for subsequent removal from the fixture 48.

The foregoing description of a preferred embodiment of this invention has been presented for purposes of illustration and description. It is not intended to be exhaustive or to limit the invention to the precise form disclosed, and obviously many modifications and variations are possible in light of the above teaching. The embodiment was chosen and described in order to best explain the principles of this invention and its practical application to thereby enable others skilled in the art to utilize the invention in various embodiments and with various modifications as are suited to the particular use contemplated. It is intended that the scope of the invention be defined by the claims appended hereto.

We claim:

1. An apparatus for positioning an article in place comprising: a support means, a fixture mounted on said support means, a rotatable torque ring concentrically mounted within said fixture and housing a plurality of segments mounted thereon in a circumferential array, said segments having cam surfaces engagable by radially extending portions on said article for guiding said article into a desired elevation within said torque ring, means for rotating said torque ring for turning said article therewith to position said article in a desired orientation, wherein said support means comprises an annular support assembly including a skirt portion having circumferentially spaced arcuate slots formed therein for receiving projections provided on said article upon rotation thereof to bring said article into a pressure sealing relation against a hatch member seal.

2. An apparatus according to claim 1, including means mounted on said annular support assembly for displacing said article from said hatch member seal upon reverse rotation of said article.

3. An apparatus according to claim 2, wherein said displacing means comprises a plurality of inclined blocks mounted on said annular support assembly for engagement by said projections.

4. An apparatus according to claim 1 further comprising a plurality of inclined blocks mounted on said annular support assembly for engagement by said projections upon reverse rotation of said article to displace said article from said hatch member seal.

* * * * *